US009821567B2

(12) United States Patent
Villwock

(10) Patent No.: US 9,821,567 B2
(45) Date of Patent: Nov. 21, 2017

(54) FLUID DELIVERY SYSTEM FOR INK JET PRINTERS

(71) Applicant: Thomas Villwock, San Diego, CA (US)

(72) Inventor: Thomas Villwock, San Diego, CA (US)

( * ) Notice: Subject to any disclaimer, the term of this patent is extended or adjusted under 35 U.S.C. 154(b) by 0 days.

(21) Appl. No.: 15/329,306

(22) PCT Filed: Aug. 29, 2016

(86) PCT No.: PCT/US2016/049308
§ 371 (c)(1),
(2) Date: Jan. 26, 2017

(87) PCT Pub. No.: WO2017/040423
PCT Pub. Date: Mar. 9, 2017

(65) Prior Publication Data

US 2017/0239954 A1 Aug. 24, 2017

Related U.S. Application Data

(60) Provisional application No. 62/211,197, filed on Aug. 28, 2015.

(51) Int. Cl.
*B41J 2/165* (2006.01)
*B41J 2/175* (2006.01)

(52) U.S. Cl.
CPC ..... *B41J 2/17596* (2013.01); *B41J 2/17523* (2013.01)

(58) Field of Classification Search
None
See application file for complete search history.

(56) References Cited

U.S. PATENT DOCUMENTS

| | | | |
|---|---|---|---|
| 3,467,135 | A | 9/1969 | Muskalla |
| 2001/0013882 | A1 | 8/2001 | Niedermeyer et al. |
| 2001/0017641 | A1 | 8/2001 | Kobayashi et al. |
| 2001/0024225 | A1 | 9/2001 | Ishizawa et al. |
| 2009/0179974 | A1 | 7/2009 | Kimura |

*Primary Examiner* — Alejandro Valencia
(74) *Attorney, Agent, or Firm* — Wagenknecht IP Law Group PC

(57) ABSTRACT

A fluid delivery system for use with ink jet printers, the system including a chamber housing a fluid suitable for ink jet printing; a conduit having a distal end fluidly connected to the chamber and a proximal end configured for fluid connection to an ink jet cartridge for delivering the fluid to an inkjet printer; and a magnetic valve assembly positioned inline between the opposing ends of the conduit, to regulate flow of the fluid to the proximal end. The magnetic valve assembly operates through magnetic interaction and through the movement of a float and flap.

19 Claims, 10 Drawing Sheets

FLUID DELIVERY SYSTEM FOR INK JET PRINTERS

CROSS REFERENCE TO RELATED APPLICATIONS

This application claims priority to U.S. provisional patent application No. 62/211,197, filed Aug. 28, 2015; the content of which is herein incorporated by reference in its entirety.

BACKGROUND OF THE INVENTION

Inkjet printers use a series of nozzles to spray drops of ink directly on a substrate. The print head, which contains the series of nozzles, is the core of an inkjet printer. Inks and other jettable fluids are typically packaged in cartridges and either delivered to the print head or in other printers include the print head itself.

Because the cost of replacement cartridges is quite high, some are constructed for refill. This is typically done by injecting an ink into the empty cartridge using a syringe-like device then replacing the cartridge into its proper slot in the printer. However, this requires stopping the printer, removing the cartridge, reloading the cartridge with ink, replacing the cartridge, and restarting the printing process. Once stopped, often the entire page must be reprinted. Since each printer typically has at least four cartridges (magenta, yellow, cyan, black) this challenge is increased when a plurality of print cartridges require refilling within the same printer or across multiple printers. Therefore there remains a need for new systems for supplying jettable fluids to inkjet printers that reduce disruptions during the printing process.

SUMMARY OF THE INVENTION

The invention addresses the above needs and provides related benefits. Among these are to provide a system for fluid delivery to one or more inkjet printers that avoids a requirement that the printer be stopped to add additional printing fluid or ink. To this end, in one aspect of the invention a fluid delivery system for use with ink jet printers is provided; the system including a chamber housing a fluid suitable for ink jet printing; a conduit having a distal end fluidly connected to the chamber and a proximal end configured for fluid connection to an ink jet printer or cartridge for delivering the fluid to an inkjet printer; and a magnetic valve assembly positioned inline between the opposing ends of the conduit to regulate the pressure and flow of the fluid to the proximal end. In preferred embodiments the fluid is an ink; however, any fluid used with inkjet printers would be suitable as the system is itself intended to regulate the delivery pressure of fluids ultimately to an inkjet print head.

In some embodiments, the chamber is housed within a module, which itself includes a mechanism for attachment to other similar modules and provides one or more feed apertures for feeding the conduit there through. This permits efficient storage of a plurality of chambers to feed a plurality of printers. Nonlimiting examples of suitable mechanisms of attachment include magnetic attachment, complementary interlocking surfaces that reversibly interlock, and friction fitting. The modules can also include the conduit or portions thereof, and the magnetic valve assembly. In some embodiments the module includes a first compartment for insertion of the chamber and a second compartment for packaging the conduit and magnetic valve assembly. Relatedly in some embodiments the system includes a print cartridge in fluid communication with the conduit. In such cases, the cartridge can also be initially packaged in the second compartment then removed for insertion into a printer.

The conduit provides a passageway to deliver the fluid from the chamber, through the valve, and to a connectable inkjet printer, which preferably remains connected during the printing process. In preferred embodiments the conduit is one or more segments of polymer tubing, preferably at least two segments joining the inline magnetic valve assembly between the chamber and the inkjet printer. At one or more opposing ends of the conduit, and/or at ends connecting an inline magnetic valve assembly, there can be one or more quick connect fittings.

The magnetic valve assembly maintains a delivery pressure at the proximal end of the conduit between 2-50 mbar, more preferably 3-10 mbar, which is the preferred range for many inkjet applications. In preferred embodiments, the magnetic valve assembly includes a body; a collar; and a flap configured to engage the collar by a force of magnetic attraction. This engagement closes the flap to prevent passage of fluid through the body; whereas disengagement opens the flap to permit passage of the fluid through the body. Engagement and disengagement are regulated in part by configuring the flap and collar such that the magnetic force of attraction between the collar and flap is greater than a force of positive pressure being applied by the fluid coming from the chamber and less than the combined force of this positive pressure coming from the chamber and a force of negative pressure that is selectively applied during inkjet printing through the proximal end of the conduit. By configuring the materials to exert a magnetic force within this tolerance, the flap is biased closed prior to applying the force of negative pressure and selectively opens when the force is applied during inkjet printing. Once opened and the negative pressure released, closing the flap is further assisted by way of a float, which may be integral with the flap or may be separate from the flap. By balancing the buoyancy of the float together with the strength of the magnetic attraction between the collar and flap, the valve can configured within the tolerance required for proper opening and closing of the flap. Balancing the magnetic force can be by adjusting the size and strength of magnetic material.

In some embodiments the collar is formed at least in part from a metal and the flap is formed at least in part from magnetic material for the magnetic attraction. In other embodiments the collar is formed at least in part from magnetic material and the flap is constructed at least in part from a metal for the magnetic attraction. In still other embodiments the collar and flap each have one or more magnets with opposite poles facing one another for attraction.

It is preferably to have an o-ring to assist with fluid tight sealing of the collar and flap when in the closed position. It is another feature of the invention to provide a magnetic o-ring, which is formed from a polymer tubing filled with magnetic particles. Balancing the magnetic force may be performed by adjusting the amount of magnetic particles within the tubing. The magnetic particles can be millimeter sized magnetic particles, micron sized or nanoparticles in a solution. In some embodiments the magnetic particles are mixed with a polymer in liquid form, added to the polymer tubing then polymerized. In other embodiments, the magnetic particles are provided in a liquid solution and remain in liquid form, which may increase the ability to compress the o-ring for an effective seal. In some embodiments, the collar and flap are each formed at least in part from a same or different metal, and the collar is coupled to an o-ring formed of polymer tubing filled with the magnetic particles.

In other embodiments, the collar and flap are each a formed at least in part from a same or different metal, and the flap is coupled to an o-ring formed of polymer tubing filled with the magnetic particles. In still another embodiments the collar and flap are each formed at least in part from a same or different metal, and each is coupled to an o-ring formed of polymer tubing filled with the magnetic particles. In some embodiments the magnetic valve provides magnetic repulsive forces to help push the float distally when closing the valve.

In some embodiments the flap is entirely detachable from the body, but in other embodiments the flap is hinged to the body. In contrast, the float preferably remains detached from the body but could be slidably attached through a sliding guide along the body or attached to a hinged flap. Relatedly, the float can remain detached but float between one or more guide walls, optionally having a passageway and through-bores for fluid delivery. Further, the float can be solid and nonporous, but in other embodiments a plurality of through-bores traverse the float to permit fluid to traverse the float itself.

The float is configured to move proximally when applying the force of negative pressure, such as during inkjet printing, to ensure the flap is unobstructed when opening. The float is also configured to float distally when the force of negative pressure is released. This distal movement of the float repositions the flap next to the collar, which permits the magnetic attraction to occur between the flap and collar thereby again closing the flap.

In some embodiments the system includes a plurality of conduits and a plurality of inline magnetic valve assemblies connecting the chamber to a plurality of print cartridges for delivering the fluid to one or more inkjet printers. Relatedly, in some embodiments the system includes a plurality of chambers, a plurality of conduits and a plurality of inline magnetic valve assemblies connecting the plurality of chambers to a plurality of print cartridges for delivering the fluid to one or more inkjet printers. In further embodiments, at least two of the plurality of chambers are fluidly connected to one another through interconnectors and shared tubing.

DETAILED DESCRIPTION OF PREFERRED EMBODIMENTS

Figure 1:
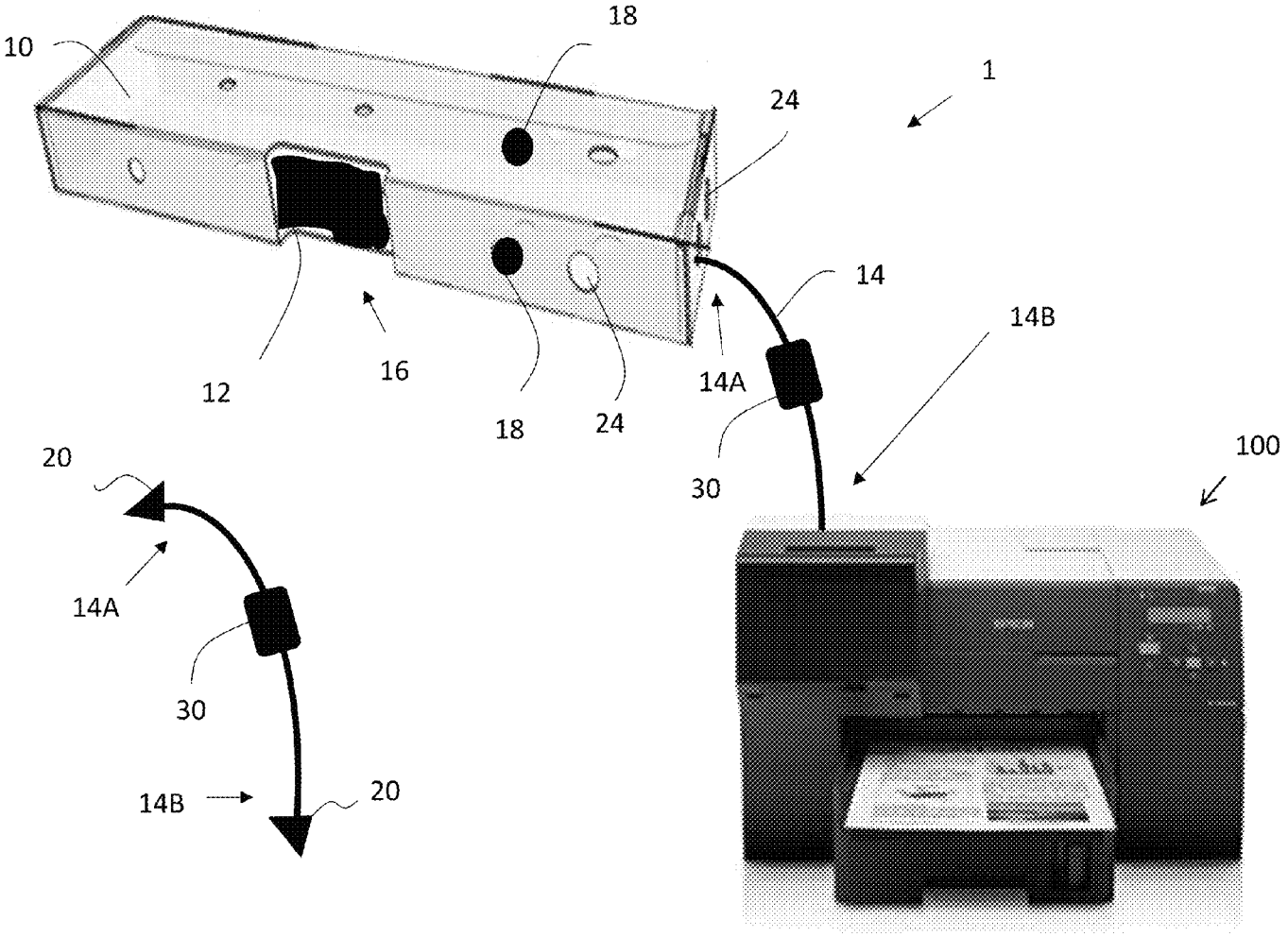
FIG. 1 depicts a connection between a single module 10 and an inkjet printer 100.

As shown generally FIGS. 1-4, the invention provides a fluid delivery system 1 for use with ink jet printers 100, where the system includes a chamber 12 storing a fluid suitable for ink jet printing; a conduit 14 having a distal end 14A fluidly connected to the chamber 12 and a proximal end 14B configured for fluid connection to an ink jet printer 100, such as through a connected print cartridge 110; and a magnetic valve assembly 30 positioned inline between the opposing ends 14A, 14B of the conduit 14 to regulate the pressure and flow of the fluid to the proximal end 14B.

The chamber 12 used to hold the fluid is typically formed of a non-rigid polymer that collapses on itself as the fluid is dispensed. This permits fluid delivery through the system 1 under vacuum. To this end, a challenge was identified in that a chamber 12 that collapses can be difficult to stack. Further modifications where made to address a central object of the invention, namely, to provide a system 1 that can be easily expanded and maintained, such as by stacking to minimize the space for storage and hot-swapping to avoid the need to shut down printing while exchanging chambers 12. One option was to configure the chambers 12 so that they collapse equally around sidewalls of the chamber 12. Providing a top and bottom that is more rigid than the sidewalls such that the sidewalls selectively collapse before the top and bottom deform could assist with stacking. However, an additional problem was encountered. In particular stacking collapsible chambers 12 increases the force of positive pressure Fp at the inkjet head. That is, the increased weight from stacking chambers 12 increased the positive pressure Fp to the print head from chambers 12 positioned lower in the stack, which can cause the printer 100 to over-jet. As such, this configuration would require additional steps or modifications such as selectively accessing chambers 12 from the top of the stack before the bottom of the stack.

Ultimately, the solution was to create a module 10 in the form of a rigid housing to store the chamber 12, which can be hot swapped. The module 10 was created with a section for safely storing the collapsible chamber 12 away from compressive forces of other chambers 12, and a cutout or viewing window 16 to visually monitor the remaining volume of fluid. The module 10 was further developed to increase the safety and efficiency during stacking and hot swapping. In particular the modules 10 are configured with one or more mechanisms for reversible attachment 18 to one another and configured to fluidly join in groups to permit access to same print cartridges 110 from more than one chamber 12, thereby providing a system 1 that is modular, easily expandable and adaptable to different inkjet platforms and across different performance levels. When using this array approach, modules 10 grouped within the array of modules 10, can be hot-swapped during print operation without interruption.

In furtherance of the above, the modules 10 can be used to supply a plurality of different fluids for a variety of print systems. To this end, the fluids themselves may depend on the intended print system and therefore may vary in viscosity, surface tension, and formulation as known in the particular field. In some embodiments, the print system includes an inkjet printer 100 and the fluid has a suitable viscosity and surface tension for inkjet jet printing. The skilled artisan will also appreciate that the fluid can contain a number of different colorants or pigments as needed and can be provided in a variety of volumes. In some embodiment the array of modules 10 includes individual modules 10 for magenta 10*a*, yellow 10*b*, blue 10*c* and black 10*d*; each having a volume of about 500 to 1000 mL. In other embodiments each module 10 can contain two or more chambers 12 of two or more different fluids. In still other embodiments, the fluid is suitable for use with magnetic character ink recognition (MICR) by providing particles that can be magnetized in the presence of a magnetic field. The modularity of the array provides that individual modules 10 can be swapped as needed.

In some embodiments, the module 10 has an optical detection system for detecting the amount of fluid within a chamber 12 of the corresponding module 10 so that the amount of fluid can be monitored. In some embodiments, the optical detection system is a viewing window 16 that exposes a portion of the chamber 12. This configuration may be sufficient when each module is viewable. In some embodiments, a sensor placed within the module 10 can detect the height of the collapsible chamber 12. Such a sensor can be by way of emitting a signal from one wall of the module 10 and detecting the presence or absence of signal at an opposing wall, where the signal is uninterrupted once the chamber 12 collapses to a desired level.

In a preferred embodiment, the modules 10 supply ink or fluid to a printer such as into one or more print cartridges 110 adapted to receive the fluid. The fluid is delivered from the chamber 12 via the conduit 14, which is typically one or more segments of polymer tubing, connected to chamber 12 and printer 100 using quick connect fittings 20. In preferred embodiments the fluid is stored under vacuum such that fluid can be drawn from the chamber 12 in response to negative pressure induced during disbursement from the print cartridge 110. By providing quick connect fittings 20 and a conduit 14 that maintains an air-tight seal, a vacuum can be maintained, while swapping chambers 12. This air-tight seal can be maintained during connection by utilizing appropriate sealing surfaces within the quick connect fittings 20, such as o-rings, self sealing membranes, and self sealing septums, coupled with male to female connectors.

Although flow through the conduit 14 is regulated by the valve assembly 30, further assistance can be provided by providing a suitable inner diameter within the conduit 14, where widening or narrowing the diameter may affect the flow rate and/or pressure. The artisan can determine an acceptable inner diameter in view of the particular need and the teachings throughout this document.

Cartridges 110 can be adapted to receive fluid from modules 10 by integrating a suitable access aperture or complementary fitting on the cartridge 110 itself that connects to the quick connect fitting 20 or the conduit 14 of the module 10. Alternatively, the cartridge 110 may itself have a feeder tube with a complementary fitting for connection to the quick connect fitting 20 on the conduit 14. Connections between the cartridge 110 and chamber 12 preferably remain air-tight and are reversible, which permits hot-swapping of modules.

In some embodiments a single module 10 delivers fluid to a plurality of cartridges 110. The plurality of cartridges 110 receiving a same fluid from a same module 10 may be from a same printer 100 or may be from different printers 100. Delivering fluid across a plurality of cartridges 110 in a same printer can ensure each cartridge 110 across a same array of cartridges 110 maintains a suitable supply of fluid to avoid inconsistencies in printing across the array of cartridges 110; and delivering fluid to cartridges 110 in different printers 100 can ensure a central supply across an array of printers 100.

Fluid can be selectively delivered from a single module to a plurality of cartridges 110 by providing a distinct conduit 14 between each chamber 12 and cartridge 110 or by incorporating one or more splice connectors 22. In such embodiments, a splice connector 22 may have an inlet 22A for receiving the fluid from the chamber 12 and two or more branched outlets 22B for delivery. In some embodiments the inlet 22A has a larger diameter than an outlet 22B. Directionality of the splice connector 22 can be maintained through the selective use of male and female adapters. Splice connectors 22 can incorporate quick connect fittings that are air tight. Preferably, the splice connectors 22 are housed within the module 10 but exterior to the chamber 12, which can avoid confusion when operating an array of modules 10. The conduit 14 then passes a feed aperture 24 to exit the module 10. When delivering fluid to a plurality of cartridges 110, a plurality of conduits 14 may traverse a single feed aperture 24. Though sizing may vary and may be optimized for any particular use, in a preferred embodiment the feed aperture 24 is sized to permit passage of 8 conduits 14.

In some embodiments the array of fluid delivery modules 10 includes a plurality of modules 10 that are fluidly connected to one another. In such embodiments an adapter depicted as an interconnector 26 (also referred to as a cross connector) can interconnect fluids between different modules 10. Preferably, such interconnectors 26 would share connection to one or more cartridges 110 by providing at least two inlets 26A to accept fluid from at least two different modules 10 and one or more outlets 26B to share the accepted fluid across the cartridges 110. In some embodiments a least three modules 10 are combined by providing an interconnector 26 having at least three inlets 26A for accepting fluid from at least three modules 10 and at least one outlet 26B for delivering the fluid. In still further embodiments, four modules 10 are combined by providing an interconnector 26 with at least four inlets 26A for accepting fluid from the four modules 10 and delivered fluid through at least one outlet 26B. Interconnectors 26 may incorporate quick connect fittings that are air tight for hot-swapping modules 10.

In some embodiments, each module 10 has at least two interconnectors 26, where each interconnector 26 within a same module 10 is fluidly connected to accept fluid stored within the same chamber 12 within the module 10 and from one or more different chambers 12 from other modules 10. The artisan will now appreciate that interconnectors 26 provide a mechanism to share access to fluid across an array of modules 10 and thus provide a hot-swappable system that interconnects different modules 10.

In some embodiments, the array of modules 10 has a plurality of individual modules 10 interconnected through interconnectors 26, and where the outlet 26B of the interconnectors 28 is fluidly connect to a splice connector 22, which provides a central route for sharing access to fluid from a plurality of modules 10 to a plurality of cartridges 110.

As indicated above, the array of modules 10 can include a plurality of modules 10. As such, the invention also provides a mechanism for storing or housing the plurality of modules 10. That is, maintaining a plurality of interconnected or partially interconnected modules 10 can provide challenges, especially when multiple conduits 14 deliver fluid from a same chamber 12.

To address the above challenges, modules 10 are preferably shaped to permit stacking and preferably have a mechanism for attachment 18 with one another. In some embodiments the mechanism for attachment 18 includes magnets 19 of opposite polarity. In other embodiments magnets 19 and magentizable metal are aligned for complementary magnetic attachment. In still other embodiments, the mechanism 18 may include releasable clips or bands, hook and loop (VELCRO), tongue and groove, or any other suitable attachment mechanism.

Figure 2:
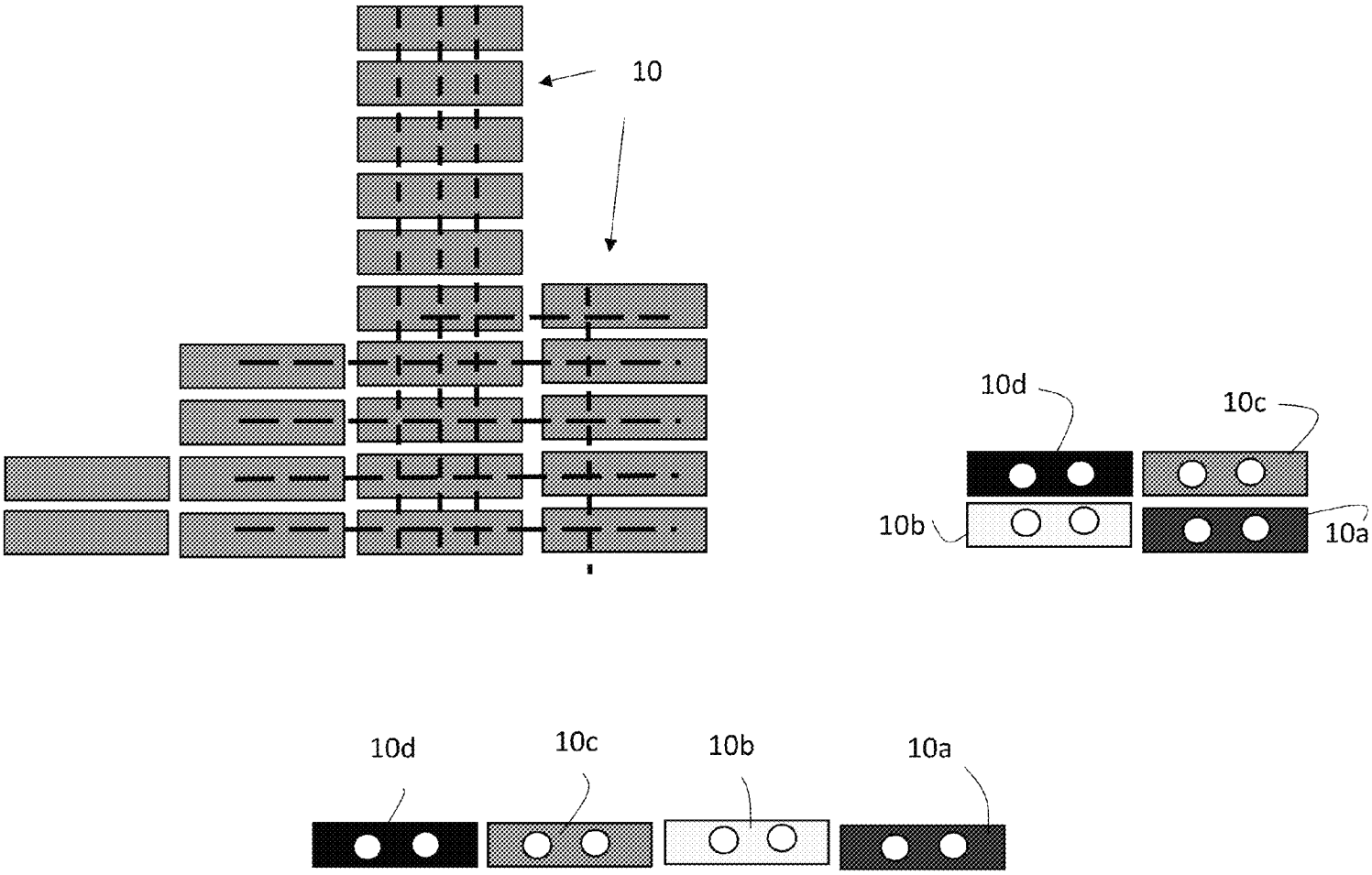
FIG. 2 depicts an interconnected array of modules 10.
Figure 3:
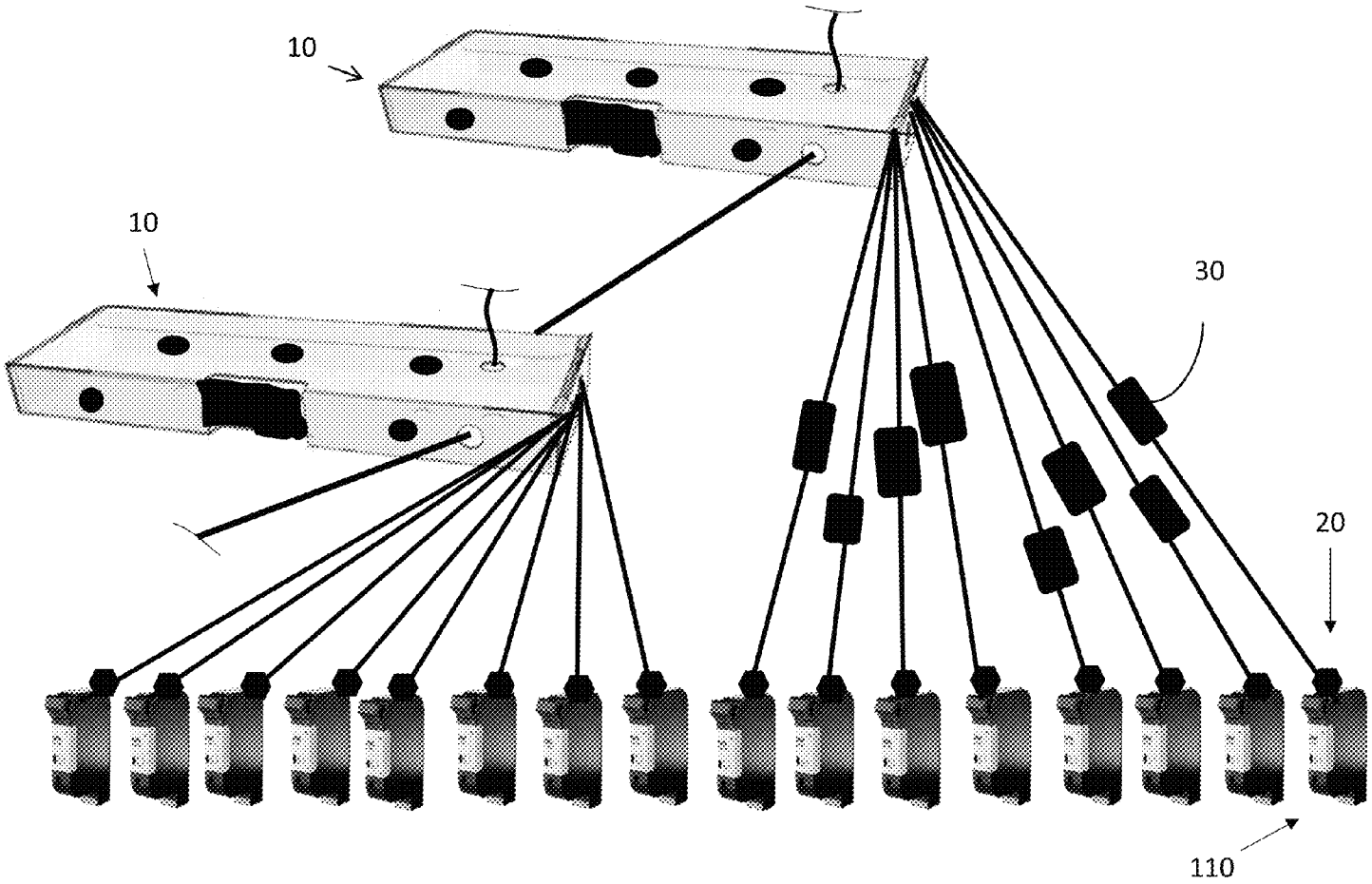
FIG. 3 depicts the interconnection of two modules 10 for delivering fluid across a plurality of inkjet cartridges 110.
Figure 4:
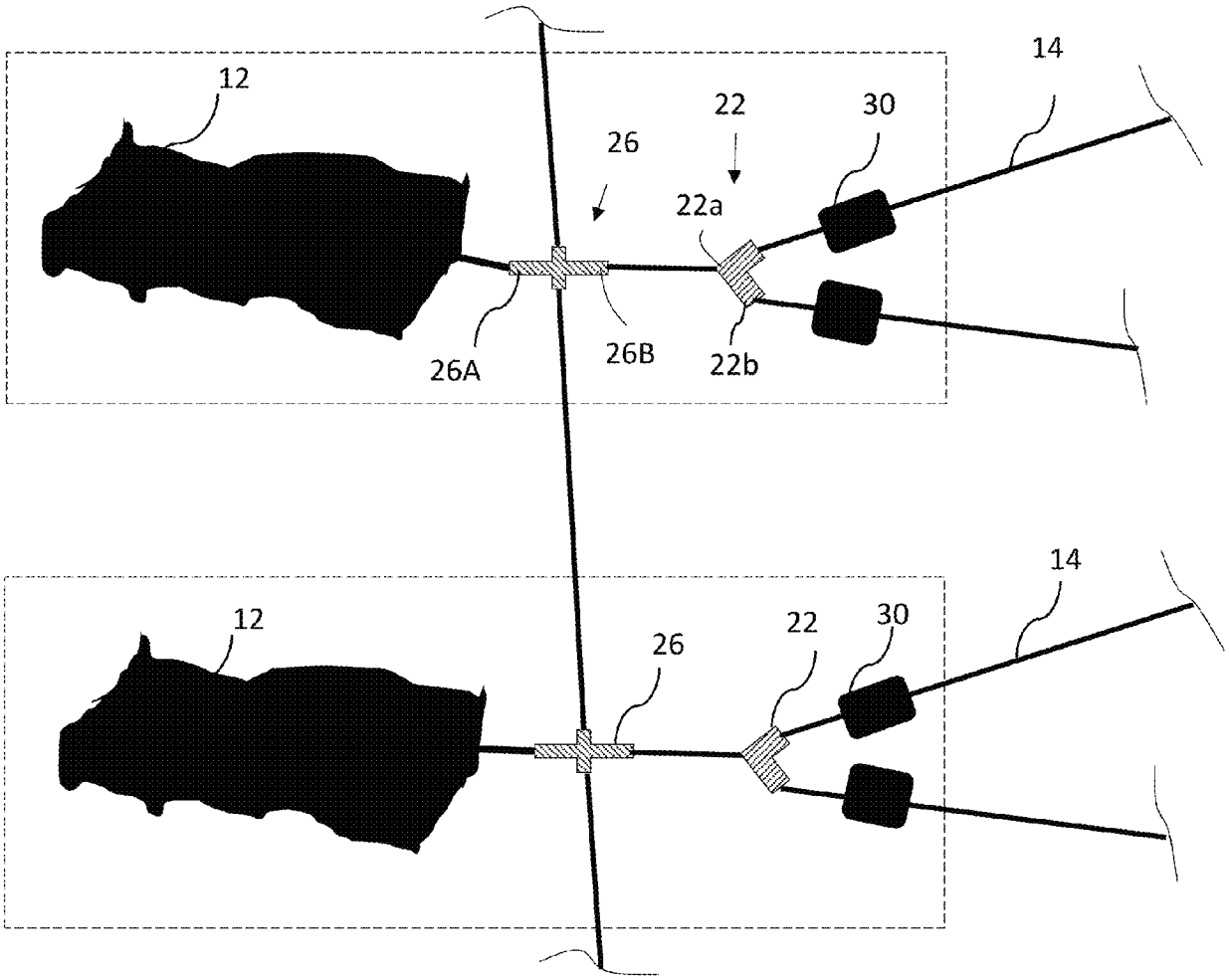
FIG. 4 depicts an interior of an exemplary module 10.

Modules 10 within an array can be arranged in any suitable order and may be stacked or grouped according to each particular fluid, such as by color or contents. In some embodiments modules of different content (such as different color) are stacked two by two, where the modules are for magenta 10*a*, yellow 10*b*, blue 10*c* and black 10*d*. In other embodiments, modules 10 are stacked one by four. Non limiting examples of connecting configurations are shown in FIGS. 2-4.

The magnetic valve assembly 30 is positioned inline between the opposing ends 14A, 14B of the conduit 14, to regulate flow of fluid for delivery to the inkjet printer 100. Turning to FIGS. 5-9, the magnetic valve assembly 30 is characterized as having a hollow body 32; a collar 34 positioned within the body 32; a flap 36 configured to engage the collar 34 by a force of magnetic attraction Fm to form a fluid tight seal; and a float 38 positioned proximal P to the flap 36 to assist with repositioning the flap 36 in close proximity to the collar 34 so that the magnetic forces Fm can attract the flap 36 and collar 34 thereby causing the flap 36 to return to its fluid tight seal with the collar 34.

The term "configured to engage the collar" as used herein refers to an interaction between collar 34 and flap 36 preventing the flow of fluid through the valve assembly 30. This interaction can be direct contact between the collar 34 and flap 36 and/or may be through contact with an intermediate structure, such as an o-ring 50.

The magnetic valve 30 can be constructed in a variety of configurations. In each configuration, engagement between the flap 36 and collar 34 closes the flap 36 to prevent passage of fluid through the body 32 and disengagement opens the flap 36 to permit passage of the fluid through the body 32. The engagement is primary held by magnetic forces Fm. Implementing the magnetic valve approach solved a problem identified when stacking multiple modules 10. In particular, it was found that stacking modules 10 at a height significantly higher than some inkjet printers 100 results in delivering ink at a higher pressure. That is, an implication of stacking modules 10 is that is that the fluid pressure Fp can build at the print head. This can result in a leaky print head. Printing at increased pressure Fp can cause over jetting, which results in less defined, blurred images. In addition, the build up of fluid pressure Fp prior to printing can cause a burst of fluid once the print head initially opens, also causing less defined, blurry images. Thus, it was desirable to counter the force Fp of fluid pressure applied by the supply chambers 12 and to regulate the pressure at the proximal end 14B of the conduit 14.

The solution was obtained by constructing a new pressure regulator, and its integration into the conduit 14. In particular, the magnetic valve assembly 30 was constructed, where the force of magnetic attraction Fm between the collar 34 and flap 36, which closes the valve 30 is greater than a force of positive pressure Fp applied by the fluid from the chamber 12. However, another challenged remained in that the ink must still be deliverable. Thus, the magnetic valve assembly 30 was further construed such that the force of magnetic attraction Fm is less than a combined force Ft, which is a sum of the force of positive pressure Fp coming the chamber (s) 12 and an applied force of negative pressure Fn through the proximal end 14B of the conduit 14, which is induced by the inkjet printer 100. However, still another challenged remained in that it was desirable to again substantially, if not completely, block the pressure Fp of fluid coming from the chamber 12 once printing is stopped to again prevent the build up of pressure Fp at the print head.

Yet another solution was developed to construct a float 38 configured to move proximally P when applying the force of negative pressure Fn to permit the flap 36 to open and to float distally D against the flap 36 when the force of negative pressure Fn released to reposition the flap 36 next to the collar 34 thereby permitting magnetic attraction between the flap 36 and the collar 34, which closes the flap 36. The float 38 is thus constructed of a material having a lower density than the fluid, which encourages it to rise distally. Examples of such materials can widely differ but are typically polymers. The result was a flap 36 that is biased closed prior to applying the force of negative pressure Fn; opens when the force of negative pressure Fn is applied to an amount that controls the proper flow, and returns to its closed position after release of the negative pressure Fn. Nonlimiting structural configurations of the magnetic valve assembly 30 have been developed to meet these requirements.

Figure 5B:
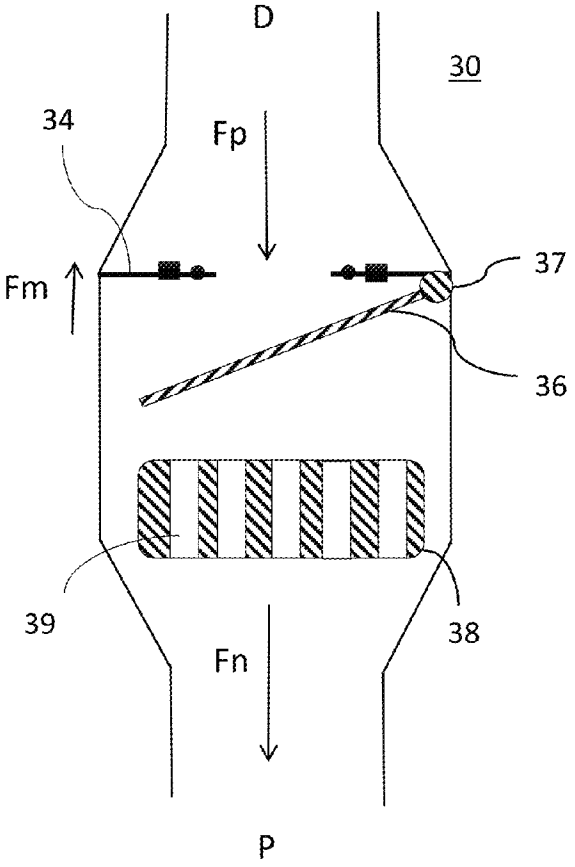
FIGS. 5A-B depicts an embodiment of the magnetic valve assembly having a hinged flap 36.
Figure 5A:
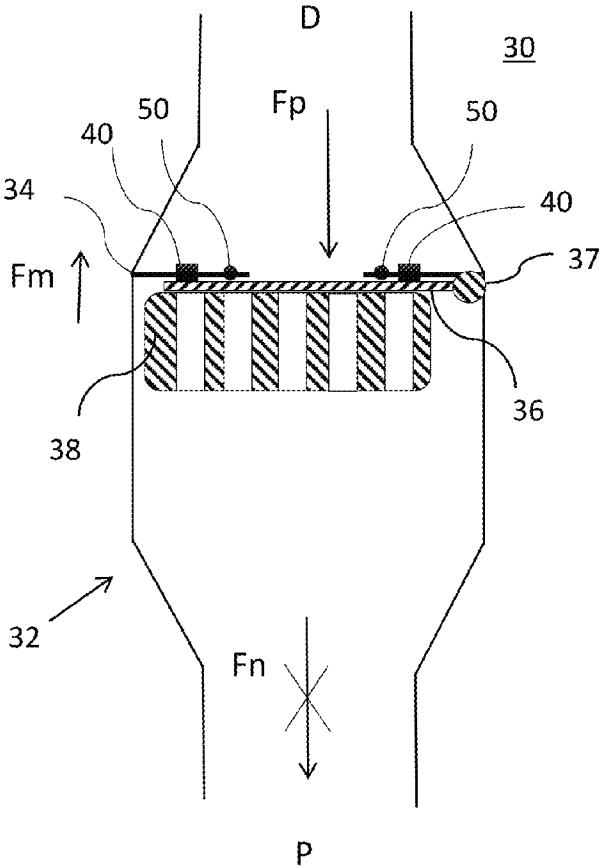

FIGS. 5A-B provide an embodiment of the magnetic valve assembly 30, where the flap 36 is hinged. In FIG. 5A a metallic flap 36 remains closed in its biased position against a collar 34 by forces of magnetic attraction Fm with magnetic elements 40 mounted to the collar 34. A nonmagnetic o-ring 50 is also shown. The magnetic attraction Fm between the collar 34 and flap 36 through the magnetic element 40 is sufficient to overcome the force of distally applied positive pressure Fp. In FIG. 5B, negative pressure Fn is applied proximally to the valve assembly 30, such as during inkjet printing. Since the force of magnetic attraction Fm is a balance between the force of positive pressure Fp without and with the applied force of negative pressure Fn, both the flap 36 and float 38 selectively move proximally P to open the valve 30 when the negative pressure Fn is applied. In this embodiment, the flap 36 moves along a hinge 37. The valve 30 is now open and fluid is permitted to flow. The float 38 is also shown with pores 39, which permit the fluid to flow through the float 38. Once the negative pressure Fn is released, the float 38, being less dense than the fluid, moves distally D and to reposition the flap 36 along the hinge 37 near the collar 34 such that the force of magnetic attraction Fm returns the valve 30 to the closed position shown in FIG. 5A.

Figure 6B:
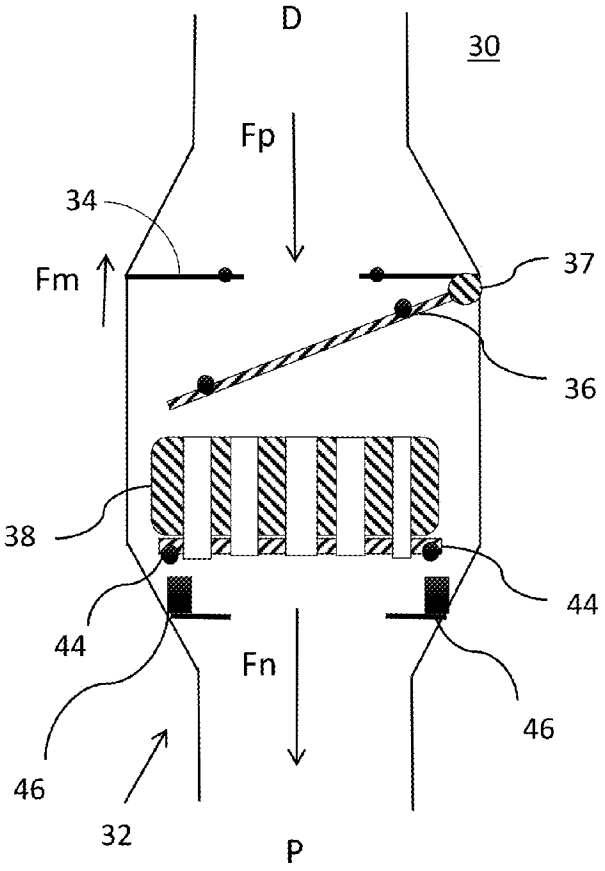
FIGS. 6A-B depicts another embodiment of the magnetic valve assembly having a hinged flap 36.
Figure 6A:
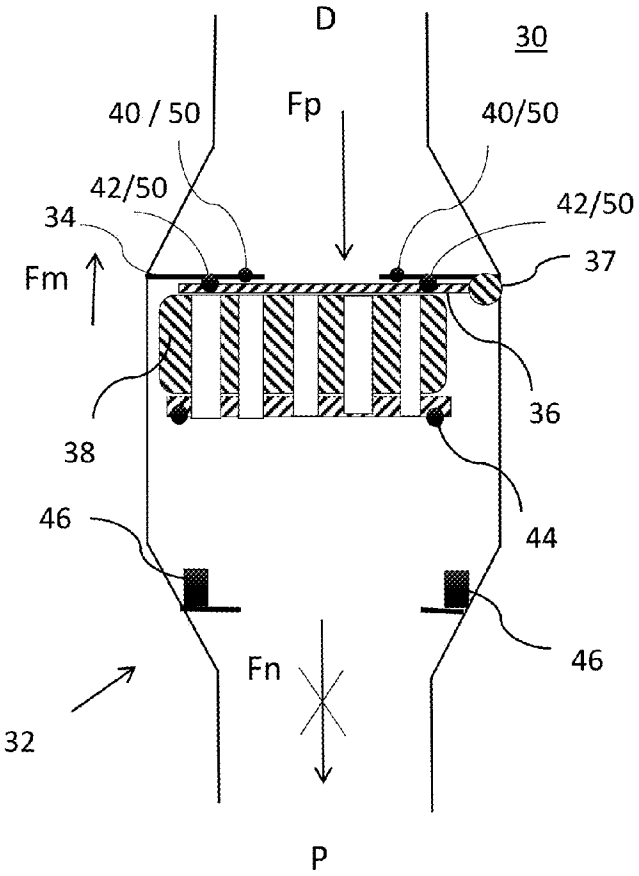

FIGS. 6A-B provide another embodiment of the magnetic valve assembly, where the flap 36 is hinged. In FIG. 5A a metallic flap 36 remains closed in its biased position against a metallic collar 34 by attraction with magnetic elements 40, 42 mounted to either the collar 34 or flap 36. Magnetic elements 44 are also positioned on the lower (or proximal) portion of the float 38, which has a metallic coating for ease of magnetic element 44 attachment. The magnetic attraction Fm between the collar 34 and flap 36 (via the magnetic elements 40, 42 embodied in polymer tubing 52 as an o-ring 50 (see FIGS. 10A-B)) is sufficient to overcome the force of distally D applied positive pressure Fp. In FIG. 6B, negative pressure Fn is applied proximally P to the valve assembly 30. Since the force of magnetic attraction Fm is balance between the force of positive pressure Fp without and with the applied force of negative pressure Fn, both the flap 36 and float 38 selectively move proximally P to open the valve 30 when the negative pressure Fn is applied. In this embodiment, the flap 36 moves along a hinge 37. The valve 30 is now open and fluid is permitted to flow. Towards the proximal end P of the body 32 is positioned a repulsive magnetic element 46 facing a same exposed polarity as magnetic element 44 on the lower portion of the float 38, which attempts to repel the float 38. Once the negative pressure Fn is released, the float 38, being less dense than the fluid, moves distally D and to reposition the flap 36 along the hinge 37 near the collar 34 such that the force of magnetic attraction Fm returns the valve 30 to the closed position shown in FIG. 6A.

Figure 7B:
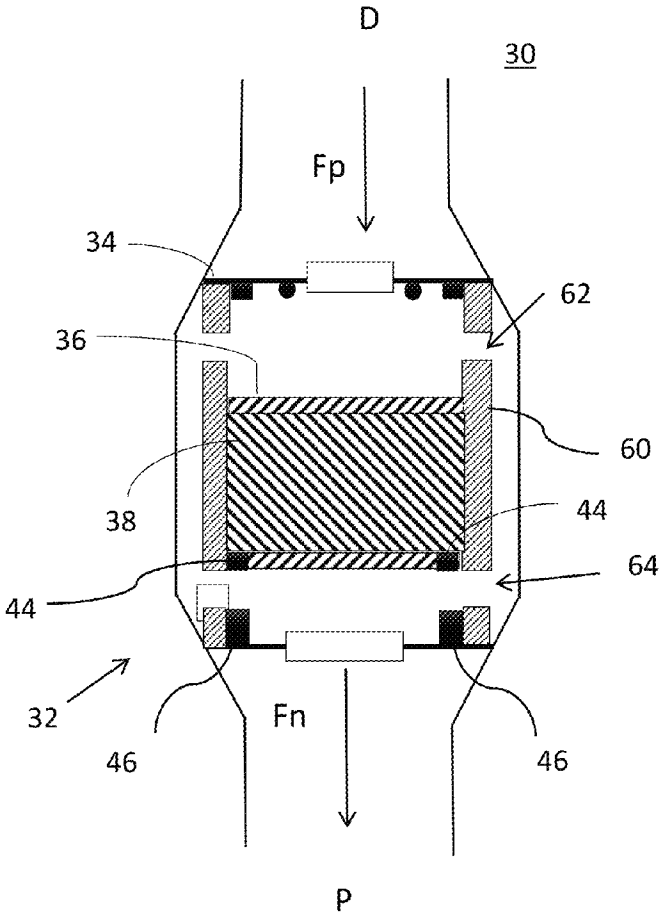
FIGS. 7A-B depicts an embodiment of the magnetic valve assembly having an integral flap 36 and float 38.
Figure 7A:
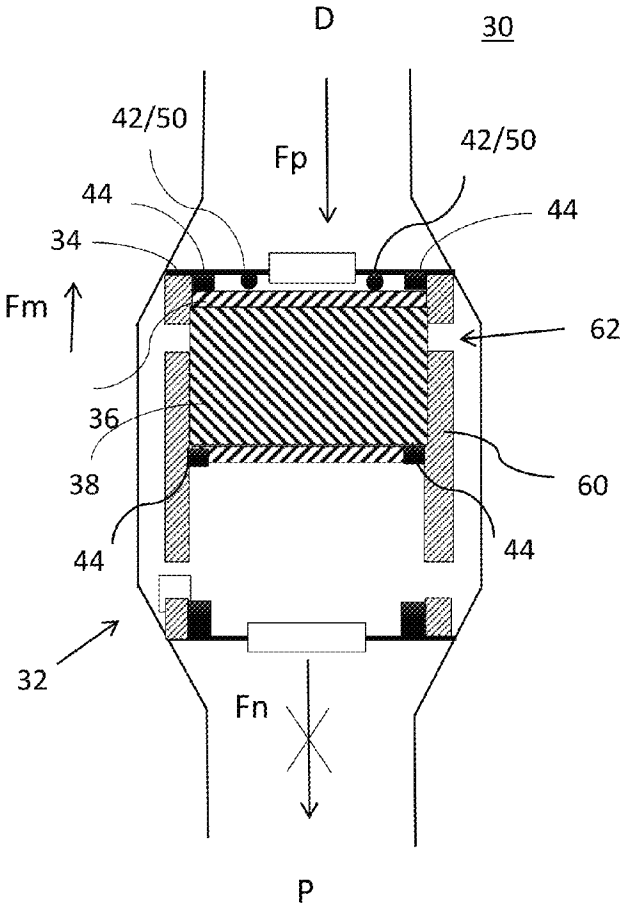

FIGS. 7A-B provide an embodiment of the magnetic valve assembly 30, where the flap 36 and float 38 are integral. In FIG. 7A a metallic flap 36 remains closed in its biased position against a metallic collar 34 by attraction with magnetic elements 40 (embodied as a magnetic o-ring 50) mounted within each of two grooves of the collar 34. Magnetic elements 44 are also positioned on the lower (or proximal) portion of the float 38, which has a metallic coating for ease of magnetic element 44 attachment. The magnetic attraction Fm between the collar 34 and flap 36 (via the magnetic elements 40 embodied in polymer tubing 52 as an o-ring 50 (see FIGS. 10A-B)) is sufficient to overcome the force of distally applied positive pressure Fp. In FIG. 7B, negative pressure Fn is applied proximally P to the valve assembly 30. Since the force of magnetic attraction Fm is balance between the force of positive pressure Fp without and with the applied force of negative pressure Fn, both the flap 36 and float 38 selectively move proximally P along a guide wall 60 until a throughbore 62 is exposed to open the valve 30 when the negative pressure Fn is applied. The valve 30 is now open and fluid is permitted to flow. Towards the proximal P end of the body 32 is an exit aperture 64 to permit exiting flow of fluid and a repulsive magnetic element 46 that has a same exposed polarity as magnetic elements 44 on the lower portion of the float 38, which repels the float 38 to prevent blockage of the exit aperture 64. Once the negative pressure Fn is released, the float 38, being less dense than the fluid, moves distally D and to reposition the flap 36 near the collar 34 such that the force of magnetic attraction Fm returns the valve 30 to the closed position shown in FIG. 7A.

Figure 8B:
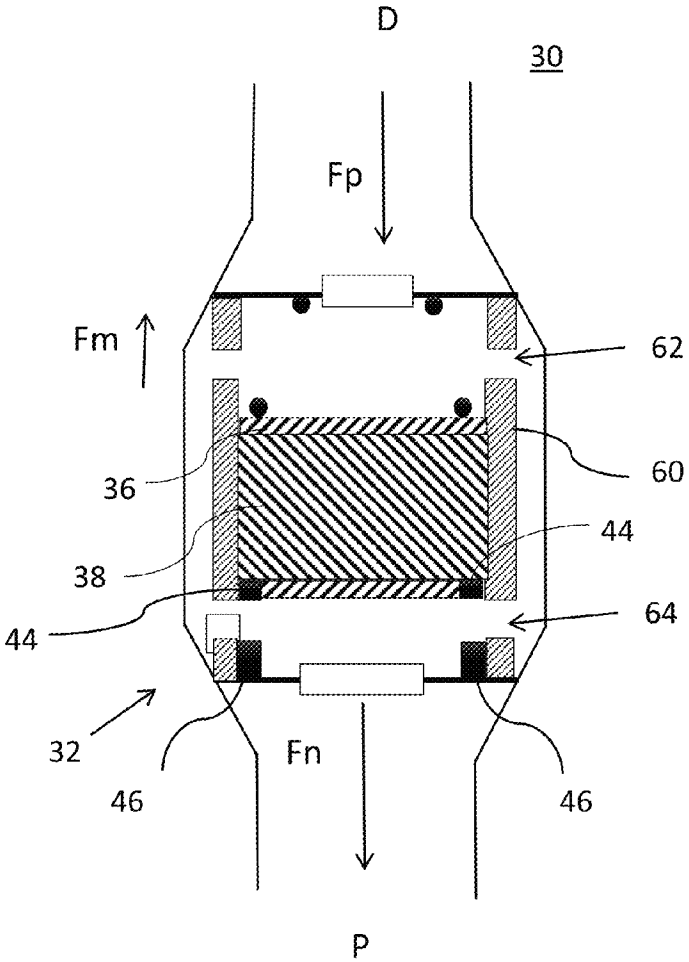
FIGS. 8A-B depicts another embodiment of the magnetic valve assembly having an integral flap 36 and float 38.
Figure 8A:
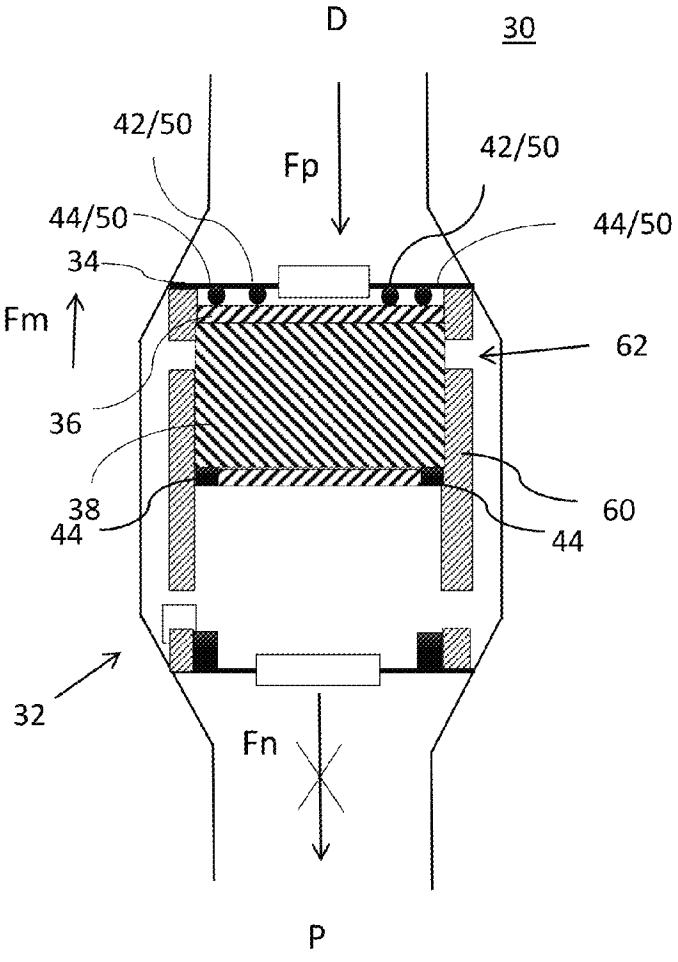

FIGS. 8A-B provide another embodiment of the magnetic valve assembly 30, where the flap 36 and float 38 are integral. In FIG. 8A a metallic flap 36 remains closed in its biased position against a metallic collar 34 by attraction with magnetic elements 40, 42 (embodied as magnetic o-rings 50 (see FIGS. 10A-B)) mounted within each of a groove of the collar 34 and a groove of the flap 36. Magnetic elements 44 are also positioned on the lower (or proximal) portion of the float 38, which has a metallic coating for ease of magnetic element 44 attachment. The magnetic attraction Fm between the collar 34 and flap 36 is sufficient to overcome the force of distally applied positive pressure Fp. In FIG. 8B, negative pressure Fn is applied proximally P to the valve assembly 30. Since the force of magnetic attraction Fm is balance between the force of positive pressure Fp without and with the applied force of negative pressure Fn, both the flap 36 and float 38 selectively move proximally P along a guide wall 60 until a throughbore 62 is exposed to open the valve 30 when the negative pressure Fn is applied. The valve 30 is now open and fluid is permitted to flow. Towards the proximal P end of the body 32 is an exit aperture 64 to permit exiting flow of fluid and a repulsive magnetic element 46 that has a same exposed polarity as magnetic element 44 on the lower portion of the float 38, which repels the float 38 to prevent blockage of the exit aperture 64. Once the negative pressure Fn is released, the float 38, being less dense than the fluid and being repelled by magnetic elements 46, moves distally D and to reposition the flap 36 near the collar 34 such that the force of magnetic attraction Fm returns the valve 30 to the closed position shown in FIG. 8A.

Figure 9B:
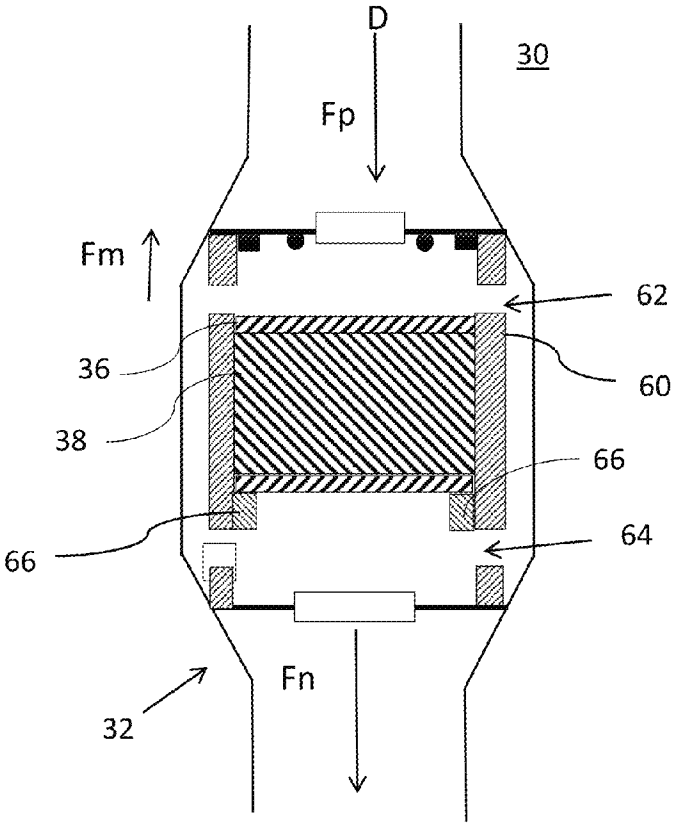
FIGS. 9A-B depicts yet another embodiment of the magnetic valve assembly having an integral flap 36 and float 38.
Figure 9A:
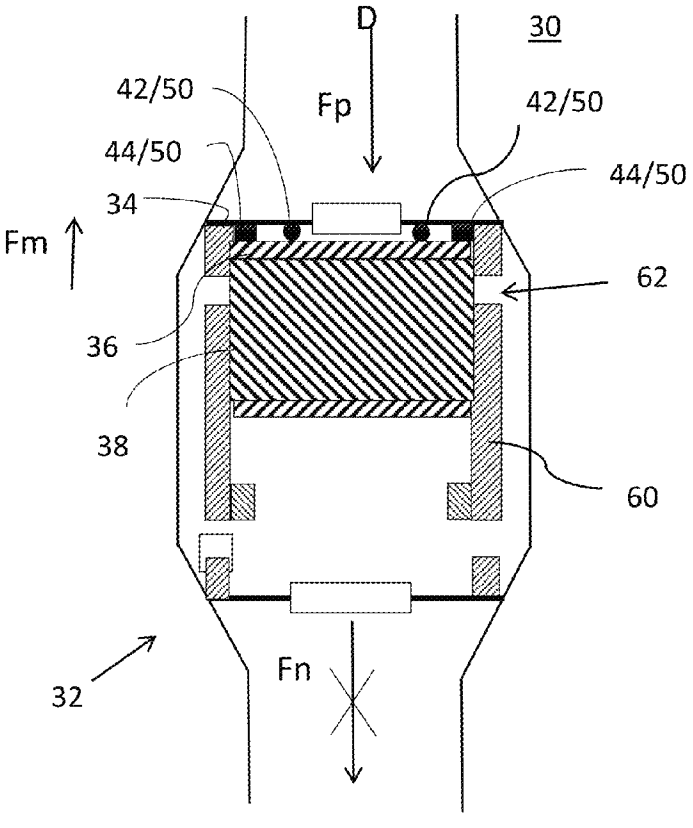

FIGS. 9A-B provide another embodiment of the magnetic valve assembly 30, where the flap 36 and float 38 are integral. In FIG. 9A a metallic flap 36 remains closed in its biased position against a metallic collar 34 by attraction with magnetic elements 40 (embodied as magnetic o-rings 50 (see FIGS. 10A-B)) mounted within each of two grooves of the collar 34. The magnetic attraction Fm between the collar 34 and flap 36 is sufficient to overcome the force of distally D applied positive pressure Fp. In FIG. 9B, negative pressure Fn is applied proximally P to the valve assembly 30. Since the force of magnetic attraction Fm is balance between the force of positive pressure Fp without and with the applied force of negative pressure Fn, both the flap 36 and float 38 selectively move proximally P along a guide wall 60 until a throughbore 62 is exposed to open the valve 30 when the negative pressure Fn is applied. The valve 30 is now open and fluid is permitted to flow. Towards the proximal P end of the body 32 is an exit aperture 64 to permit exiting flow of fluid. Along the guide wall are positioned two barriers 66 sized to prevent interference of the float 38 with the exit aperture 64. Once the negative pressure Fn is released, the float 38, being less dense than the fluid, moves distally D and to reposition the flap 36 near the collar 34 such that the force of magnetic attraction Fm returns the valve 30 to the closed position shown in FIG. 9A.

Figure 10B:
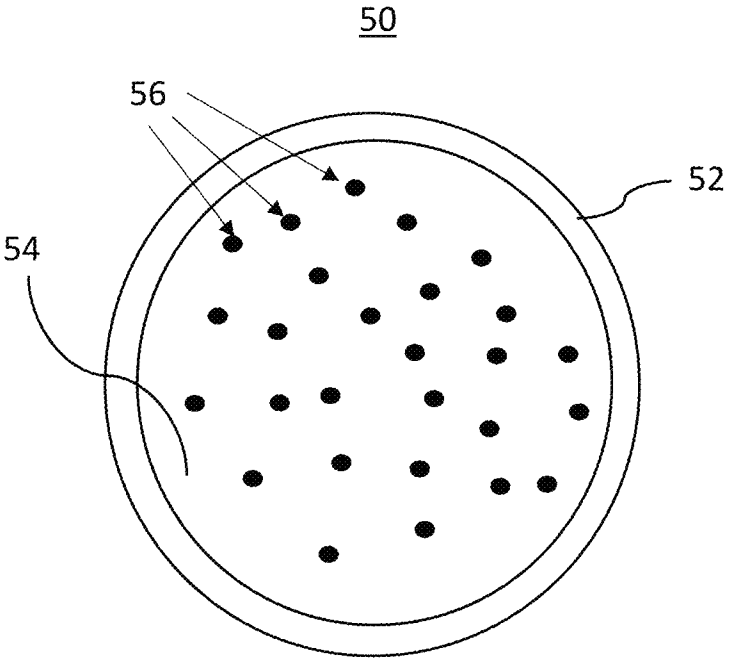
FIGS. 10A-B depict a magnetic o-ring 50.
Figure 10A:
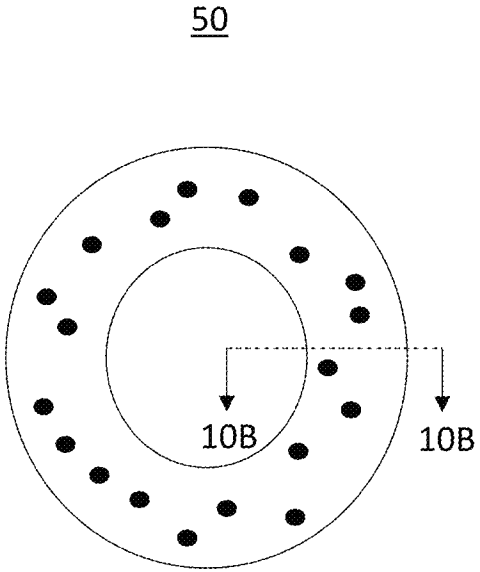

FIGS. 10A-B provide a more detailed view of a magnetic o-ring 50. FIG. 10A is a top view of an exemplary o-ring 50 and FIG. 10B is a corresponding cross sectional view. In constructing the magnetic o-ring 50, polymer tubing 52 having an open inner lumen 54 is filled with one or more magnetic particles 56. The magnetic particles can be millimeter sized, micron sized or nano-sized. In some embodiments the magnetic particles 56 are be magnetic material milled to appropriate size for inserting into the lumen 54. In other embodiments the magnetic particles 56 can be material that can be made magnetic in the presence of a magnetic field, which can be performed before or after construction. An example of magnetizable nanoparticles are provided in U.S. Pat. No. 9,390,846; the content of which is herein incorporated by reference in its entirety. The magnetic particles 56 can be held in the lumen in a liquid solution and thus establishing a "magnetic fluid.". In other embodiments, the magnetic particles are suspended in a polymer solution, the polymer solution is then added to the lumen 54, and the polymer solution is polymerized to suspend the magnetic particles 56 as a solid. Polymer formation through inducing polymerization is itself well known in the art.

What is claimed is:

1. A fluid delivery system for use with ink jet printers, the system comprising:

a) a chamber housing a fluid suitable for ink jet printing;

b) a conduit comprising a distal end fluidly connected to the chamber and a proximal end configured for fluid connection to an ink jet cartridge for delivering the fluid to an inkjet printer; and c) a magnetic valve assembly positioned inline between the opposing ends of the conduit, to regulate flow of the fluid to the proximal end, wherein the magnetic valve assembly comprises:

i) a hollow body;

ii) a collar positioned within the body;

iii) a flap configured to engage the collar by a force of magnetic attraction, wherein the engagement closes the flap to prevent passage of fluid through the body and disengagement opens the flap to permit passage of the fluid through the body, further wherein the force of magnetic attraction is greater than a force of positive pressure applied by the fluid from the chamber and less than a combined force of the force of positive pressure and an applied force of negative pressure through the proximal end of the conduit thereby biasing the flap closed prior to applying the force of negative pressure; and iv) a float configured to move proximally when applying the force of negative pressure to permit the flap to open and configured to float distally against the flap when the force of negative pressure is released to reposition the flap next to the collar to induce magnetic attraction with the collar thereby closing the flap.

2. The fluid delivery system of claim 1, wherein the chamber is housed within a module comprising a mechanism for attachment to other similar modules.

3. The fluid delivery system of claim 2, wherein the mechanism for attachment is selected from the group consisting of magnetic attachment, complementary interlocking surfaces, and friction fit.

4. The fluid deliver system of claim 1, wherein the fluid is an ink.

5. The fluid delivery system of claim 1, wherein the fluid connection is by way of quick connect fittings.

6. The fluid delivery system of claim 1, wherein the collar is a continuous loop.

7. The fluid delivery system of claim 1, wherein the collar comprises a metal and the flap comprises a magnet for the magnetic attraction.

8. The fluid delivery system of claim 1, wherein the collar comprises a magnet and the flap comprises a metal for the magnetic attraction.

9. The fluid delivery system of claim 1, wherein the collar and flap each comprise a same or different metal, further wherein the collar is coupled to an o-ring formed of polymer tubing filled with a magnetic fluid.

10. The fluid delivery system of claim 1, the collar and flap each comprise a same or different metal, further wherein the flap is coupled to an o-ring formed of polymer tubing filled with a magnetic fluid.

11. The fluid delivery system of claim 1, the collar and flap each comprise a same or different metal, and each is coupled to an o-ring formed of polymer tubing filled with a magnetic fluid.

12. The fluid delivery system of claim 1, wherein the collar and flap comprise magnets with opposite poles facing one another.

13. The fluid delivery system of claim 1, wherein the flap is hinged to the body.

14. The fluid delivery system of claim 1, wherein the float comprises a plurality of throughbores to permit passage of the fluid.

15. The fluid delivery system of claim 1, wherein the force of negative pressure is an applied force through the proximal end, optionally 2-50 mbar, using the inkjet printer during ink jet printing.

16. The fluid delivery system of claim 1, further comprising an inkjet cartridge fluidly coupled to the proximal end of the conduit.

17. The fluid delivery system of claim 1, comprising a plurality of conduits and a plurality of inline magnetic valve assemblies connecting the chamber to a plurality of print cartridges for delivering the fluid to one or more inkjet printers.

18. The fluid delivery system of claim 1, comprising a plurality of chambers, a plurality of conduits and a plurality of inline magnetic valve assemblies connecting the plurality of chambers to a plurality of print cartridges for delivering the fluid to one or more inkjet printers.

19. The fluid delivery system of claim 18, wherein at least two of the plurality of chambers are fluidly connected to one another through shared tubing.

* * * * *